US006287371B1

(12) United States Patent
Ota et al.

(10) Patent No.: US 6,287,371 B1
(45) Date of Patent: Sep. 11, 2001

(54) NON-ELECTROLYTIC GOLD PLATING LIQUID AND NON-ELECTROLYTIC GOLD PLATING METHOD USING SAME

(75) Inventors: Yasuo Ota; Yasushi Takizawa; Haruki Enomoto, all of Ohmiya (JP)

(73) Assignee: LeaRonal Japan Inc., Tokyo (JP)

( * ) Notice: Subject to any disclaimer, the term of this patent is extended or adjusted under 35 U.S.C. 154(b) by 0 days.

(21) Appl. No.: 09/433,568

(22) Filed: Nov. 4, 1999

(30) Foreign Application Priority Data

Nov. 5, 1998 (JP) ..... 10-330199

(51) Int. Cl.[7] ..... C23C 18/31
(52) U.S. Cl. ..... 106/1.18; 106/1.23; 106/1.26
(58) Field of Search ..... 106/1.18, 1.23, 106/1.26; 427/436

(56) References Cited

U.S. PATENT DOCUMENTS

| | | | | |
|---|---|---|---|---|
| H325 | * | 9/1987 | Mallory, Jr. et al. | 106/1.23 |
| 4,830,668 | * | 5/1989 | Wundt et al. | 106/1.23 |
| 5,322,552 | * | 6/1994 | Dettke et al. | 106/1.23 |
| 5,364,460 | * | 11/1994 | Morimoto et al. | 106/1.23 |
| 5,803,957 | * | 9/1998 | Murakami et al. | 106/1.23 |

FOREIGN PATENT DOCUMENTS

| | | | |
|---|---|---|---|
| 3537283 | * | 4/1986 | (DE) . |
| 2034756 | * | 6/1980 | (GB) . |

OTHER PUBLICATIONS

Derwent abstract of DE3537283, Apr. 1986.*

* cited by examiner

*Primary Examiner*—Helene Klemanski
(74) *Attorney, Agent, or Firm*—Oblon, Spivak, McClelland, Maier & Neustadt, P.C.

(57) ABSTRACT

The present invention provides an excellent non-electrolytic gold plating liquid which produces a gold plating layer firmly adhered to a surface selected from the group consisting of nickel, cobalt, palladium or a metal alloy containing nickel, cobalt or palladium, as well as a method for performing a non-electrolytic gold plating method using the non-electrolytic gold plating liquid. The non-electrolytic gold plating liquid comprises:

(1) a water-soluble gold compound;

(2) a complexation agent which stabilizes a gold ion in the plating liquid, but does not substantially dissolve nickel, cobalt or palladium; and (3) an anti-gold deposit agent which inhibits excess local etching or corrosion by substitution reaction between the metal surface and gold during the gold plating.

15 Claims, 2 Drawing Sheets

NON-ELECTROLYTIC GOLD PLATING LIQUID AND NON-ELECTROLYTIC GOLD PLATING METHOD USING SAME

TECHNICAL FIELD OF THE INVENTION

The present invention relates to a non-electrolytic gold plating liquid and non-electrolytic gold plating method using the non-electrolytic gold plating liquid to form a gold plating layer for electronic industrial parts or articles, such as a print wiring base board and ITO base board, etc. Further, the present invention provides excellent adherence between the base metal and gold layer by inhibition of a local and excess etching or corrosion of metal to be gold plated (or prevent extension of the depth or horizontal etching or corrosion of the subject metal surface). The present invention makes it possible to achieve strong soldering strength between the base metal and the gold plated metal prepared thereon by using the non-electrolytic gold plating liquid. Thus, the present invention relates to a non-electrolytic gold plating liquid, and a method for gold plating using such a non-electrolytic gold plating liquid.

TECHNICAL BACKGROUND OF THE INVENTION

Gold plating has been applied to the surface of industrial electronics parts or articles, such as print wiring board, ceramic IC package, ITO base board, IC card, etc., due to favorable properties of gold, such as electric conductivity, soldering capacity, physical property (e.g., connection by thermal pressure), resistance to oxidation and chemical stability. Many of these parts or articles are required to be gold plated at an electrically independent area. Therefore, electric gold plating is not suitable and non-electrolytic gold plating method has to be used.

Currently two methods are available: a method using a substitution gold plating liquid by which gold deposits as the base metal, such as nickel, dissolves; and autocatalytic type gold plating by which gold is produced from gold compounds by reducing agents wherein gold itself has a catalytic action for it. These two types of non-electrolytic gold plating liquids are widely known.

In the case of the substitution gold plating, gold deposits by substituting the base metal, namely, the base metal dissolves (etching or corrosion) as gold deposits. Currently available substitution gold plating liquids are unable to control the rate of substitution reaction, as a result, the substitution rate is very high at the onset of reaction. Especially, many defect spots on the substituted gold layer are produced right after the reaction due to that fast substitution reaction, causing continuous defect spots or localized defect area. Etching or corrosion on the base metal under the defect gold plating layer progresses vertically deep or horizontally wide excessively. Consequently, in the case where the gold plating is carried out using such a substitution gold plating liquid, a part of the base metal where there is structurally weak crystalline grain boundary is dissolved (etching and corrosion) preferentially and convergently. Accordingly, it is known that in the case where gold plating is carried out by use of the currently available substitution gold plating liquid, deep crevasse-like etching along the grain boundary or wide horizontal corrosion develops excessively in the base metal after the gold plating layer is formed.

For example, when general non-electrolytic nickel or gold plating is carried out using the known non-electrolytic nickel plating bath or substitution gold plating bath, scanning electron microscopic examination of a slice of substitution gold layer of 0.05 to 0.1 $\mu$m thickness on non-electrolytically plated nickel layer of 0.5 $\mu$m revealed that the gold plating liquid preferentially attacked the deposited grain boundary portion of the non-electrolytically formed nickel layer, causing deep corrosion at the grain boundary, resulting in the formation of a cavity under the gold layer. Although the thickness of the gold layer is only 0.1 $\mu$m or less, the depth of corrosion is 3 to 5 $\mu$m. Such weakening of the non-electrolytically plated nickel layer after the substitution gold plating and unsatisfactory adherence between the gold layer and nickel layer makes the resultant product unendurable to soldering and hence impractical.

Also, the autocatalytic type gold plating is a two-step process: right after immersion of the base metal to be plated in the plating liquid, gold deposits by substitution reaction between the base metal and gold ion, and then the deposited gold initiates gold-catalyzed reducing action, causing sedimentation of gold. Accordingly, in the case of the autocatalytic type gold plating, it is not possible to prevent etching and corrosion of the base metal caused by gold plating liquid.

Such a plated layer with insufficient adherence is prone to peel off during efficacy tests or is unable to provide strength for soldering, resulting in exposure of the base metal after soldering and during soldering strength tests. Recently, however, a ball grid array type semiconductor package manufactured by using print board wiring technique is widely used as a package for microprocessor. In a ball grid array type semiconductor package, it is necessary to perform gold plating on an electrically independent pattern to improve soldering strength. However, there is a big problem on production of defect products due to inadequate soldering strength in the currently available non-electrolytic gold plating technology. Therefore, electric plating technology is still being used to attain necessary soldering strength.

SUMMARY OF THE INVENTION

One object of the present invention is to provide a non-electrolytic gold plating liquid which provides an improved adherence between a base metal layer and a gold-plated layer.

Another object of the present invention is to provide a method for non-electrolytic gold plating which provides an improved adherence between a base metal surface and a gold-plated layer.

In order to attain those objects, the present inventors have made intensive studies and found that these objects can be overcome by using a non-electrolytic gold plating liquid comprising a combination of the specific components. The present invention has been completed on the basis of the new finding.

Specifically, the present invention relates to the following inventions:

1. A non-electrolytic gold plating liquid used in gold plating over a metal surface selected from the group consisting of nickel, cobalt, palladium and a metal alloy containing nickel, cobalt or palladium, said gold plating liquid comprising the following components:

(1) a water-soluble gold compound;

(2) a complexation agent which stabilizes a gold ion in said plating liquid, but does not substantially dissolve nickel, cobalt or palladium; and (3) an anti-gold deposit agent which inhibits excess local etching or corrosion by substitution reaction between said metal surface and gold during the gold plating.

2. An non-electrolytic gold plating method comprising the steps of:

(1) providing the non-electrolytic gold plating liquid of the above item 1; and (2) immersing an article having a surface of a metal selected from nickel, cobalt, palladium, or a metal alloy containing nickel, cobalt or palladium, in said non-electrolytic gold plating liquid.

BRIEF DESCRIPTION OF THE INVENTION

Figure 1:
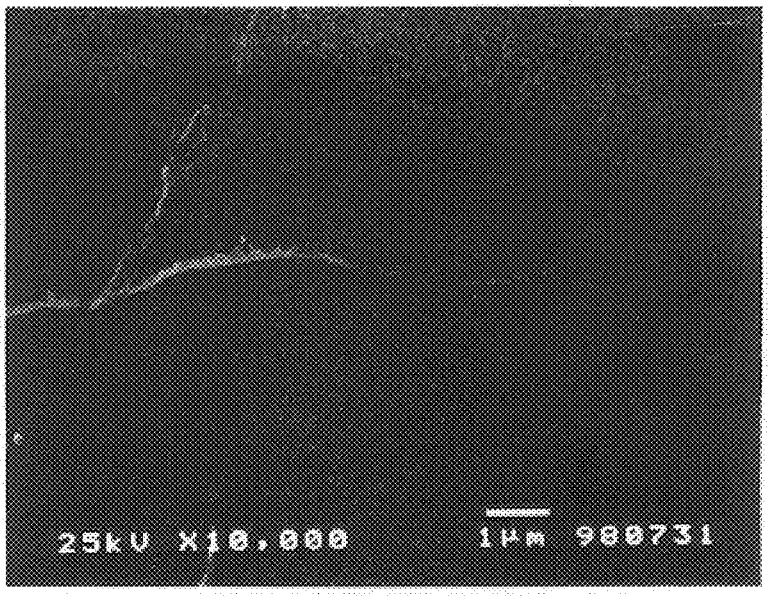
FIG. 1 shows an electron microscopic photograph of bisected face of the plated subject obtained by Example 4.

The present invention will be explained in detail below.

The water-soluble gold compound used in the present invention may be any compound so long as such a compound is soluble in water and capable of providing a gold ion in the plating solution. Those compounds are not necessarily limited to those compounds already used in the gold plating, but various other compounds may be used.

These water-soluble gold compounds include, for example, potassium aurous [gold(I)] cyanide, potassium auric [gold(II)] cyanide, chloroauric acid sodium salt, ammonium goldsulfite, potassium goldsulfite, or sodium goldsulfite, etc.

One or more than two water-soluble gold compounds may be used in the plating solution of the present invention. In the present invention, the concentration of the water-soluble gold compound may be 0.1–10 g/L, preferably 1–5 g/L as a gold ion. If the concentration of a gold ion is lower than 0.1 g/L, the plating reaction becomes very slow or difficult to start. On the other hand, if the concentration of a gold ion becomes higher than 10 g/L, only little favorable effects can be realized and hence uneconomical.

The complexation agent used in the present invention stabilizes the gold ion in solution but does not substantially dissolve nickel, cobalt or palladium. Such a complexation agent may include a plural phosphonic acid or phosphonic acid salt groups in the molecule.

A preferable phosphonic acid or phosphonic acid salt has the following structure:

$$—PO_3MM'$$

wherein M and M' are same as or different from each other and are selected from the group consisting of H, Na, K and ammonium ($NH_4$).

The number of a phosphonic acid or phosphonic acid salt group in the molecule is approximately 2 to 10, preferably 2 to 5.

A preferable complexation agent used in the present invention includes a compound having the following structure.

(1)

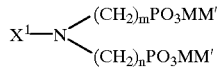

wherein $X^1$=hydrogen, alkyl group of $C_1$–$C_5$, aryl group, arylalkyl group, amino group, or $C_1$–$C_5$ alkyl group substituted with hydroxyl, carboxyl group or its salt (—COOM) or phosphonic acid or its salt (—$PO_3MM'$), wherein M and M' are as defined above and m and n are 0 or a round number of 1–5, to respectively.

The $C_1$–$C_5$ alkyl group may be a straight chain or branched chain, including methyl, ethyl propyl, isopropyl, butyl, isobutyl, sec-butyl, tert-butyl or pentyl group.

The aryl group includes phenyl, naphthyl or the like. The arylalkyl group is an alkyl group substituted with the above aryl group. The amino group includes a nitrogen atom to which is attached hydrogen or the above alkyl groups.

(2)

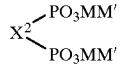

In the formula, $X^2$ is —$CH_2$—, —CH(OH)—, —C($CH_3$)(OH)—, —CH(COOM)— or —C($CH_3$)(COOM)— or the like and M and M' are as defined above.

(3)

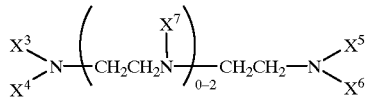

In the formula, $X^3$ to $X^7$ are same as $X^1$ above, except that at least 2 among $X^3$–$X^7$ are substituted with a phosphonic acid or a phosphonic acid salt (—$PO_3MM'$). M and M' are as defined above.

The above complexation agent specifically includes aminotrimethylene phosphonic acid, 1-hydroxyethylidene-1,1-diphosphonic acid, ethylenediamine tetramethylene phosphonic acid, diethylenetriaminepentamethylene phosphonic acid or the sodium, potassium or ammonium salt of the corresponding phosphonic acid. A single complexation agent or a mixture of two or more agents may be used in the present invention.

The concentration of the complexation agent used in the present invention may be a range of from 0.005 to 0.5 mole/L, preferably from 0.02 to 0.2 mole/L. Especially preferable is to use the complexation agent at a molar concentration same to or higher than the molar concentration of a gold ion in the plating liquid. When the concentration of the complexation agent is less than 0.005 mole/L, the agent is apt to be incapable of maintaining a gold ion in the liquid, and consequently gold is prone to precipitate from the plating liquid. On the other hand, the concentration of the complexation agent is higher 0.5 mole/L, only little improvement is realized and hence uneconomical.

The anti-gold deposit agent used in the present invention may be any material so long as such an agent impedes the rate of substitution reaction in the plating liquid by being adsorbed on the surface of the base metal selected from the group consisting of nickel, cobalt, palladium or a metal alloy containing nickel, cobalt or palladium. In the present invention, the substitution reaction can be retarded by addition of such an anti-gold deposit agent to the gold plating liquid during the gold plating, and as a result, it becomes possible to keep the defects (or holes) of the substitution gold layer formed on the base metal, small or evenly distributed. Thus, it is now possible to minimize the excess etching or corrosion of the base metal; especially it becomes possible to prevent expansion of excess etching or corrosion of the base metal surface to the horizontal and vertical (deepening) directions in respect of the surface of the article to be plated. As the consequent, it is now possible to achieve an excellent adherence between the formed gold plate layer and the base metal surface layer.

The anti-gold deposit agent used in the present invention may be any material so long as such agent has the above properties. A preferred anti-gold deposit agent includes those having no phosphonyl group in the molecule selected from the group consisting of a nitrogen-containing aliphatic compound, a reaction product between a nitrogen-containing aliphatic compound and an epoxy group-containing compound, a nitrogen-containing heterocyclic compound, a reaction product between a nitrogen-containing heterocyclic compounds and an epoxy group-containing compounds, and a surfactant.

A preferred nitrogen-containing aliphatic compound has the following structure:

(4)

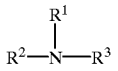

wherein $R^1$, $R^2$ and $R^3$ are independently hydrogen, alkyl group containing 1–5 carbon atoms, amino group or $(CH_2)_{1-5}—NH_2$, wherein $C_1$–$C_5$ alkyl and amino groups are defined as above.

Such nitrogen-containing aliphatic compounds specifically include methylamine, dimethylamine, trimethylamine, ethylamine, diethylamine, triethylamine, propylamine, dipropylamine, tripropylamine, and dimethylaminopropylamine.

The reaction products between the nitrogen-containing aliphatic compounds and the epoxy group-containing compounds are preferably the reaction products of the following raw materials:

A preferred nitrogen-containing aliphatic compound has the structural formula (4) above, namely, methylamine, dimethylamine, trimethylamine, ethylamine, diethylamine, triethylamine, propylamine, dipropylamine, tripropylamine, dimethylaminopropylamine and the like.

Preferred epoxy group-containing compounds have the following structural formula:

(5)

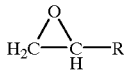

wherein R is hydrogen, alkyl group of 1–5 carbon atoms or $(CH_2)_{1-3}$—X wherein X is a halogen atom.

$C_{1-3}$ alkyl group may be straight or branched chain, preferably methyl, ethyl, propyl, isopropyl group, and preferred halogen atom is fluorine, chlorine or bromine.

Such an epoxy group-containing compound specifically includes ethylene oxide, propylene oxide, epichlorohydrin, and epibromohydrin.

Preferred nitrogen-containing heterocyclic compounds are selected from the group consisting of nitrogen-containing heterocyclic compounds which comprise 1 to 3 nitrogen atoms, 2 to 5 carbon atoms and plural hydrogen atoms, and those heterocyclic compounds to which are attached an alkyl group of 1 to 3 carbon atoms, and an amino group, wherein $C_{1-3}$ alkyl and amino are as defined earlier.

The above nitrogen-containing heterocyclic compounds include pyrrolidine, pyrrole, imidazole, pyrazole, triazole, piperidine, pyridine, piperazine, triazine and a like, and those heterocyclic compounds to which are attached an alkyl group of 1 to 3 carbon atoms, and an amino group.

Preferred reaction products between nitrogen-containing heterocyclic compounds and epoxy group-containing compounds employed in the present invention are the products from the following raw materials:

Preferred nitrogen-containing heterocyclic compounds used as raw materials are the above mentioned nitrogen-containing heterocyclic compounds, namely, pyrrolidine, pyrrole, imidazole, pyrazole, triazole, piperidine, pyridine, piperazine, triazine and the like, and those heterocyclic compounds to which are attached an alkyl group of carbon 1 to 3, and an amino group.

Preferred epoxy group-containing compounds used as raw materials are those that already described earlier.

Preferred surfactants used in the present invention have the following structural formulae:

(6)

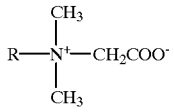

(7)

(8)

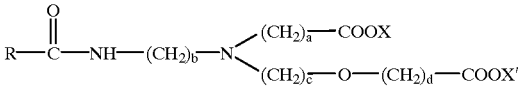

(9)

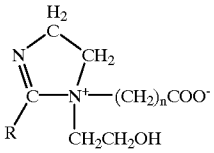

In the formula, R is $C_{8-16}$ alkyl group; X and X' are same as or different from each other and are selected from the group consisting of hydrogen, sodium, potassium and ammonium; n is a round number of 0 to 5; and a, b, c and d are the same as or different from each other and a round number 1 to 5.

The $C_{8-16}$ alkyl is a straight chain or branched chain alkyl group such as octyl, nonyl, decyl, undecyl, dodecyl, tiidecyl, tetradecyl, pentadecyl, hexadecyl, heptadecyl and octadecyl group.

A single anti-gold deposit agent or a mixture of two or more agents may be used in the present invention. The concentration of the anti-gold deposit agent used in the present invention may be a range of from 0.05 to 100 g/L, preferably from 0.2 to 50 g/L. When the concentration of the anti-gold deposit agent is lower than 0.05 g/L, the crystal grain boundary portion of the base metal under the defective gold portion (hole) is selectively attacked by substitution gold plating liquid, resulting in etching and corrosion development vertically (depth) and horizontally (large space). On the other hand, the concentration of the anti-gold deposit agent is more than 100 g/L, only little improvement is realized and hence uneconomical.

A non-electrolytic gold substitution plating liquid in the present invention can be mixed with a pH stabilizing agent. Salt of phosphoric acid, phosphorous acid, boric acid and carboxylic acids may be used as such an agent.

For adjustment of pH of the non-electrolytic gold substitution plating liquid in the present invention, for example, sodium hydroxide, potassium hydroxide, ammonia, sulfuric acid, sulfurous acid, hydrochloric acid, phosphoric acid, sulfamic acid, organosulfonic acids, phosphonic acids and carboxylic acids may be used.

In order to make finer gold precipitation grain and to gain brightness of the gold plating surface, any brightening agent may be added to the non-electrolytic gold plating liquid of the present invention. Any agent which is conventionally used for the purpose is usable, including thallium, arsenic, lead, copper, antimony, etc.

In order to attain improved moistability or wettability with the base metal, gold plating liquid of the present invention may contain a moistening agent. Various moistening agent may be used so long as the agent has been conventionally used as a moistening agent. Such a moistening agent includes non-ionic surfactants, anionic surfactants, cationic surfactants and amphoteric or bident (bi-ionic) surfactants. The bi-ionic moistening surfactant may be same as or different from the one that is included in the above anti-gold deposit agent.

Prior to processing an article to be plated by the gold plating liquid of the present invention, a pre-dip process may be used in order to prevent dilution of the components of the plating liquid. The pre-dip solution used for such pre-dip process here is an aqueous solution containing the above complexation agent and/or anti-gold deposit agent but without a gold ion.

The gold plating liquid of the present invention may also be used as an autocatalytic type non-electrolytic gold plating liquid by the addition of a reducing agent. Such a reducing agent may be, but not limited to, any of those various reducing agents used in the autocatalytic non-electrolytic gold plating. Due to the fact that the autocatalytic non-electrolytic gold plating produces favorable tight adherent substitution gold layer during the first stage of the formation of substitution gold plating layer, dissolution of the base metal (etching or corrosion) into the autocatalytic non-electrolytic gold plating liquid is prevented, and the life of the autocatalytic non-electrolytic gold plating liquid is prolonged.

The non-electrolytic plating method of the present invention may also be used as pretreatment of the autocatalytic non-electrolytic gold plating. Gold plating layer with favorable adherence may be obtained by autocatalytic non-electrolytic gold plating after covering the base metal completely by the non-electrolytic plating method of the present invention because autocatalytic reaction can be initiated without etching or corrosion of the base metal. Also by applying the non-electrolytic plating method of the present invention as pretreatment for autocatalytic non-electrolytic gold plating, dissolution of the base metal into the autocatalytic gold plating liquid can be prevented, and as a result, the life of the autocatalytic non-electrolytic gold plating liquid can be prolonged.

The non-electrolytic plating method of the present invention is used for materials covered with a layer of nickel, cobalt, palladium or an alloy containing nickel, cobalt or palladium. Nickel, cobalt, palladium or an alloy containing such a metal is used as the base metal, and substitution reaction occurs on these metals and alloys, forming the covering gold layer.

The above base metal is not necessarily a constituent of the article to be plated or does not necessarily cover entire surface of the article to be plated so long as it is present on a part of the surface of the article to be plated.

The base metal may be formed by any means such as mechanical fabrication like rolling, or electric plating, non-electrolytic plating or gas phase plating, etc. There is no limitation of thickness, but the thickness of 0.1 $\mu$m is sufficient.

When performing the non-electrolytic gold plating of the present invention, the plating temperature (liquid temperature) may be 50 to 95° C., preferably 60 to 90° C. Time required for plating may generally be 1 to 60 minutes, preferably 10 to 30 minutes.

When the temperature is lower than 50° C., the rate of formation of plating layer tends to become too slow and lower productivity and thus uneconomical, while the temperature is higher than 95° C., the components of the plating liquid may decompose.

The non-electrolytic gold plating of the present invention may be performed while stirring. Replacement filtering or circulation filtering can be done. Circulation filtering of the plating liquid with a filtering equipment is preferred; by doing this, the temperature of the plating liquid can be maintained evenly and also remove dust, precipitates in the liquid. Further, introduction of air into the liquid is possible. By this, precipitation caused by colloidal gold formation or formation of gold particles in the plating liquid can be prevented effectively. Air can be introduced as air-stirring or by bubbling independently with stirring.

As explained above, non-electrolytic gold plating liquid of the present invention and a non-electrolytic gold plating method using the non-electrolytic gold plating liquid of the present invention provide formation of gold layer intimately adherent to the base metal.

The following working examples and controls are illustrative of the method and products of the present invention, but are not to be construed as limiting.

EXAMPLE 1

Potassium gold(I) cyanide 2 g/L (as gold ion)

Ethylenediaminetetramethylenephosphonic acid 0.15 mole/L

Dimethylaminopropylamine 5 g/L pH 7.0

EXAMPLE 2

Potassium gold(I) cyanide 2 g/L (as gold ion)

Ethylenediaminetetramethylenephosphonic acid 0.15 mole/L

Reaction product between epichlorohydrin and dimethylaminopropylamine 1 g/L pH 7.0

EXAMPLE 3

Potassium gold(I) cyanide 2 g/L (as gold ion)

Ethylenediaminetetramethylenephosphonic acid 0.15 mole/L

Imidazole 5 g/L pH 7.0

EXAMPLE 4

Potassium gold(I) cyanide 2 g/L (as gold ion)

Ethylenediaminetetramethylenephosphonic acid 0.15 mole/L

Reaction product between epichlorohydrin and imidazole 1 g/L pH 7.0

EXAMPLE 5

Potassium gold(I) cyanide 2 g/L (as gold ion)

Ethylenediaminetetramethylenephosphonic acid 0.15 mole/L (10)

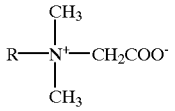

wherein R is $C_{12}$-alkyl group 5 g/L pH 7.0

EXAMPLE 6

Potassium gold(I) cyanide 2 g/L (as gold ion)

Ethylenediaminetetramethylenephosphonic acid 0.15 mole/L

R—NH—$C_2H_4$—NH—$CH_2$—COOH 5 g/L wherein R is $C_{12}$-alkyl group pH 7.0

EXAMPLE 7

Potassium gold(I) cyanide 2 g/L (as gold ion)

Ethylenediaminetetramethylenephosphonic acid 0.15 mole/L

[11]

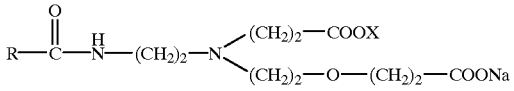

wherein R is $C_{12}$-alkyl group. 5 g/L pH 7.0

EXAMPLE 8

Potassium gold(I) cyanide 2 g/L (as gold ion)

Ethylenediaminetetramethylenephosphonic acid 0.15 mole/L (12)

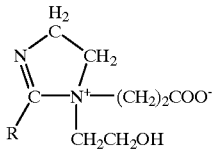

wherein R is $C_{12}$-alkyl group. 5 g/L pH 7.0

EXAMPLE 9

Potassium gold(I) cyanide 2 g/L (as gold ion)

Aminotrimethylenephosphonic acid 0.15 mole/L

Imidazole 5 g/L pH 7.0

EXAMPLE 10

Potassium gold(I) cyanide 2 g/L (as gold ion)

1-Hydroxyethylidene-1,1-diphosphonic acid 0.15 mole/L

Imidazole 5 g/L pH 7.0

Control 1

(without anti-gold deposit agent)

Potassium gold(I) cyanide 2 g/L (as gold ion)

Ethylenediaminetetramethylenephosphonic acid 0.15 mole/L pH 7.0

Control 2

(with known substitution gold plating liquid)

Potassium gold(I) cyanide 2 g/L (as gold ion)

Ethylenediaminetetraacetic acid disodium 0.32 mole/L

Citric acid 0.38 mole/L

Phosphoric acid 1.54 mole/L

Potassium hydroxide 1.89 mole/L pH 5.8

Control 3

(with known autocatalytic non-electrolytic plating liquid)

Potassium gold(I) cyanide 1 g/L (as gold ion)

Potassium cyanide 0.17 mole/L

Ethylenediaminetetraacetic acid disodium 0.013 mole/L

Potassium hydroxide 0.2 mole/L

Ethanolamine 0.8 mole/L

Tetrahydroboric acid 0.2 mole/L pH 10.0

Method of measuring the rate of substitution reaction (rate of deposition by substitution plating) in the non-electrolytic gold plating bath is as follows:

A 4 cm×4 cm copper plate was nickel plated by the known procedure to approximately 5 $\mu$m thickness. This plate was gold plated in the non-electrolytic gold plating liquid of the examples and controls at 90° C. Five test plates were immersed in each plating liquid, and every 10 minutes one plate was taken out and the thickness of the gold layer was measured at each time point (10 minutes to 50 minutes) by phosphorescent X-ray minute thin layer thickness measuring equipment. From the time of immersion and the thickness of the gold layer the rate of substitution reaction (rate of deposition by substitution plating) at every 10 minutes was calculated.

Method for evaluation of strength of adherence of gold layer is as follows: A print wiring board containing a 5 $\mu$m diameter circle of a plating object was nickel plated with 5 $\mu$m thickness by a known non-electrolytic nickel plating method. Then, this board was gold plated in the non-electrolytic gold plating liquid of the examples and controls at 90° C. After the plating was carried out to a thickness of 0.05 $\mu$m, a soldering ball of 0.5 mm diameter consisting of 60% tin and 40% lead was soldered by the vapor phase soldering method. After the soldered ball was destroyed by horizontal pressure, the resulting plated surface was checked if the gold surface was peeled under microscope, and the number of peeled objects are counted.

TABLE 1

Results of Measurement of Rate of Substitution Plating Deposition

| Bath type | Upper number: thickness (mm)/Lower number: rate of deposition (mm/min) | | | | |
|---|---|---|---|---|---|
| | 10 min | 20 min | 30 min | 40 min | 50 min |
| Example 1 | 0.015 | 0.048 | 0.073 | 0.094 | 0.108 |
| | 0.0015 | 0.0033 | 0.0025 | 0.0021 | 0.0014 |
| Example 2 | 0.008 | 0.034 | 0.052 | 0.067 | 0.085 |
| | 0.0008 | 0.0026 | 0.0018 | 0.0015 | 0.0018 |
| Example 3 | 0.011 | 0.057 | 0.089 | 0.115 | 0.126 |
| | 0.0011 | 0.0046 | 0.0032 | 0.0026 | 0.0011 |
| Example 4 | 0.005 | 0.036 | 0.060 | 0.079 | 0.094 |
| | 0.0005 | 0.0031 | 0.0024 | 0.0019 | 0.0015 |
| Example 5 | 0.035 | 0.139 | 0.156 | 0.170 | 0.177 |
| | 0.0035 | 0.0104 | 0.0017 | 0.0014 | 0.0007 |
| Example 6 | 0.005 | 0.022 | 0.038 | 0.050 | 0.066 |
| | 0.0005 | 0.0017 | 0.0016 | 0.0012 | 0.0016 |
| Example 7 | 0.038 | 0.154 | 0.190 | 0.220 | 0.238 |
| | 0.0038 | 0.0116 | 0.0036 | 0.0030 | 0.0018 |
| Example 8 | 0.003 | 0.022 | 0.067 | 0.089 | 0.109 |
| | 0.0003 | 0.0019 | 0.0045 | 0.0022 | 0.0020 |
| Example 9 | 0.013 | 0.039 | 0.071 | 0.096 | 0.107 |
| | 0.0013 | 0.0026 | 0.032 | 0.0025 | 0.0011 |
| Example 10 | 0.011 | 0.044 | 0.075 | 0.096 | 0.111 |
| | 0.0011 | 0.0033 | 0.0031 | 0.0021 | 0.0015 |
| Control 1 | 0.083 | 0.126 | 0.178 | 0.218 | 0.250 |
| | 0.0083 | 0.0043 | 0.0052 | 0.0040 | 0.0032 |
| Control 2 | 0.098 | 0.156 | 0.200 | 0.234 | 0.259 |
| | 0.0098 | 0.0058 | 0.0044 | 0.0034 | 0.0025 |
| Control 3 | 0.332 | 0.673 | 0.985 | 1.286 | 1.573 |
| | 0.0332 | 0.0341 | 0.0312 | 0.0301 | 0.0287 |

TABLE 2

Results of Evaluation of Strength of Adherence of Gold Layer

| Bath Type | Number of peeled objects |
|---|---|
| Example 1 | 0/50 |
| Example 2 | 0/50 |
| Example 3 | 0/50 |
| Example 4 | 0/50 |
| Example 5 | 1/50 |
| Example 6 | 0/50 |
| Example 7 | 2/50 |
| Example 8 | 0/50 |
| Example 9 | 0/50 |
| Example 10 | 0/50 |
| Control 1 | 32/50 |
| Control 2 | 40/50 |
| Control 3 | 30/50 |

It is clear from Table 1 that, when the plating liquid containing an anti-gold deposit agent as shown in the examples, the rate of deposition of substitution gold plating is minimal in the first 10 minutes immediately after immersing the test piece into the plating liquid, and the velocity of substitution reaction is slow.

On the other hand, in the controls, the rate of deposited gold layer is maximal in the first 10 minutes immediately after immersing the test piece into the plating liquid, and the velocity of the substitution reaction is very fast immediately after immersion of the test pieces.

Table 2 shows that more than half of the gold plating layer produced in the plating liquid containing no anti-gold deposit agent as in the controls have defect as the gold layer peeled off causing exposure of the base metal during the adherence strength test. In contrast, the gold plating layer produced in the plating liquid containing an anti-gold deposit agent as in the examples provides rarely peeled off during the adherence strength test. Clearly, the non-electrolytic gold plating liquid of the present invention produced superior results, while the currently available plating liquids as used in the controls could not afford satisfactory gold plating layer to meet required quality.

Figure 2:
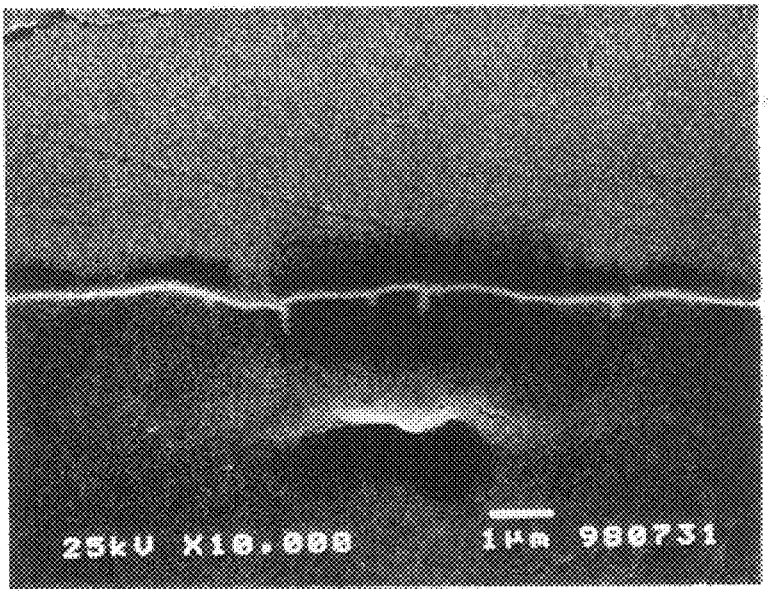
FIG. 2 shows an electron microscopic photograph of bisected face of the plated subject obtained by Example 5.
Figure 3:
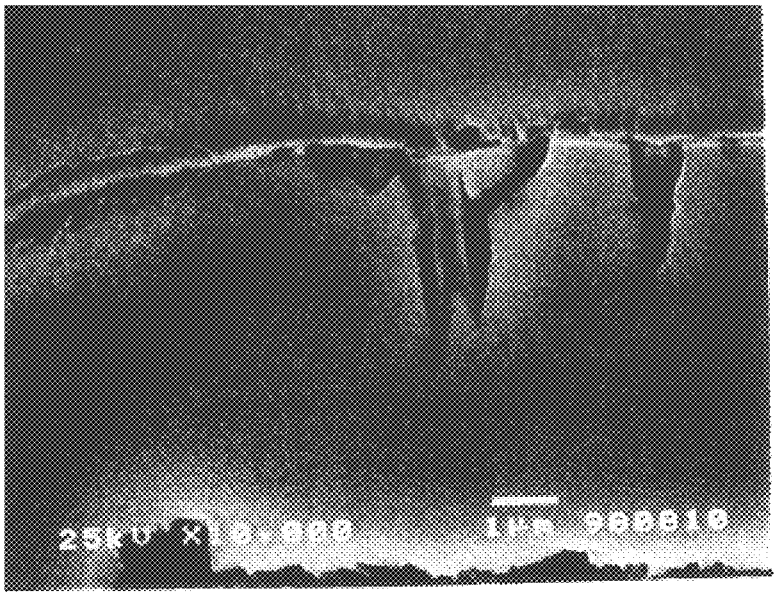
FIG. 3 shows an electron microscopic photograph of bisected face of the plated subject obtained by Control 1.
Figure 4:
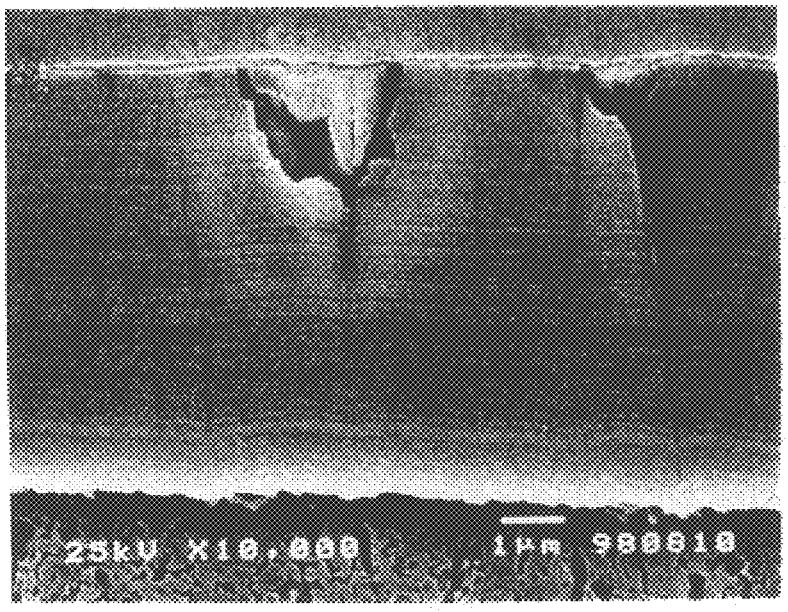
FIG. 4 shows an electron microscopic photograph of bisected face of the plated subject obtained by Control 2.

FIGS. 1 and 2 are electron microscopic photographs of bisected face of the plated articles obtained by Examples 4 and 5, respectively. It is quite clear that the gold plated layers produced are firmly adhered to the surface layer of the base metal. In contrast, the electron microscopic photographs of the bisected face of the gold plated articles obtained by Controls 1 and 2 which are presented as FIG. 3 and 4, respectively, the base metal under the gold plated layer is deeply corroded. Thus, it is clear that the gold plate layers produced by Controls 1 and 2 are not firmly adhered to the base metal surface.

As easily understood from the above, according to the present invention, it is now possible to stabilize the rate of substitution reaction immediately after initiation of reaction in performing gold plating on an article to be plated and a non-electrolytic gold plating method for producing a highly adherent gold plate layer to the base metal can be obtained.

What is claimed is:

1. A non-electrolytic gold plating liquid for gold plating over a metal surface selected from the group consisting of nickel, cobalt, palladium and a metal alloy containing nickel, cobalt or palladium, said gold plating liquid comprising the following components:

(1) a water-soluble gold compound;

(2) a complexation agent which stabilizes a gold ion in said plating liquid, but does not substantially dissolve nickel, cobalt or palladium; and (3) an anti-gold deposit agent selected from the group consisting of a reaction product between a nitrogen-containing aliphatic compound and an epoxy group-containing compound, a reaction product between a nitrogen-containing heterocyclic compound and an epoxy group-containing compound, and a surfactant selected from the group consisting of the following compounds:

(6)

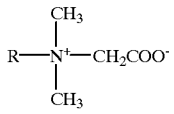

(7)

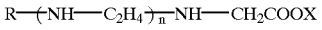

(8)

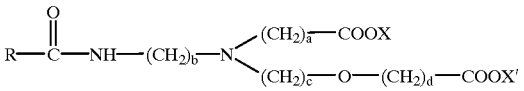

(9)

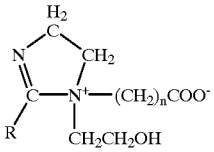

wherein R is a $C_{8-16}$ alkyl group; X and X' are the same as or different from each other and are selected from the group consisting of hydrogen, sodium, potassium and ammonium; n is 0 or a round number from 1 to 5; and a, b, c and d are the same as or different from each other and a round number from 1 to 5.

2. The non-electrolytic gold plating liquid of claim 1, wherein said nitrogen-containing aliphatic compound has the following structure:

(4)

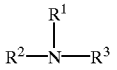

wherein $R^1$, $R^2$ and $R^3$ are independently hydrogen, a $C_{1-5}$ alkyl group, amino or $(CH_2)_{1-5}$—$NH_2$.

3. The non-electrolytic gold plating liquid of claim 2, wherein said nitrogen-containing aliphatic compound is selected from the group consisting of methylamine, dimethylamine, trimethylamine, ethylamine, diethylamine, triethylamine, propylamine, dipropylamine, tripropylamine, and dimethylaminopropylamine.

4. The non-electrolytic gold plating liquid of claim 1, wherein said epoxy group-containing compound is represented by the following formula (5):

(5)

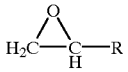

wherein R is hydrogen, a $C_{1-5}$ alkyl group or $(CH_2)_{1-3}$—X wherein X is a halogen atom.

5. The non-electrolytic gold plating liquid of claim 4, wherein said epoxy group-containing compound is selected from the group consisting of ethylene oxide, propylene oxide, epichlorohydrin and epibromohydrin.

6. The non-electrolytic gold plating liquid of claim 1, wherein said nitrogen-containing heterocyclic compound is selected from the group consisting of a nitrogen-containing heterocyclic compound comprising 1 to 3 nitrogen atoms, 2 to 5 carbon atoms and plural hydrogen atoms and heterocyclic compounds substituted by $C_{1-3}$-alkyl and amino.

7. The non-electrolytic gold plating liquid of claim 1, wherein said nitrogen-containing heterocyclic compound is selected from the group consisting of pyrrolidine, pyrrole, imadizole, pyrazole, triazole, piperidine, pyridine, piperazine and triazine.

8. The non-electrolytic gold plating liquid of claim 1, wherein said anti-gold deposit agent is used at a concentration of 0.05 to 100 g/L.

9. The non-electrolytic gold plating liquid of claim 8, wherein said anti-gold deposit agent is used at a concentration of 0.2 to 50 g/L.

10. The non-electrolytic gold plating liquid of claim 1, wherein said water-soluble gold compound is selected from the group consisting of potassium aurous [gold(I)] cyanide, potassium auric [gold(II)] cyanide, chloroauric acid sodium salt, ammonium goldsulfite, potassium goldsulfite, sodium goldsulfite, and a mixture thereof.

11. The non-electrolytic gold plating liquid of claim 1, wherein said water-soluble gold compound is used at a concentration of 0.1 to 10 g/L as a gold ion.

12. The non-electrolytic gold plating liquid of claim 1, wherein said water-soluble gold compound is used at a concentration of 1 to 5 g/L as a gold ion.

13. The non-electrolytic gold plating liquid of claim 1, wherein said complexation agent is a phosphonic acid or phosphonic acid salt having the following structure:

—$PO_3MM'$ wherein M and M' are same as or different from each other and are selected from the group consisting of H, Na, K and ammonium ($NH_4$).

14. The non-electrolytic gold plating liquid of claim 13, wherein said complexation agent is selected from the group consisting of compounds having the following structures:

(1)

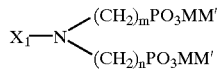

wherein $X^1$ is hydrogen, $C_1$–$C_5$ alkyl, aryl, arylalkyl, amino, or $C_1$–$C_5$ alkyl substituted with hydroxyl, carboxyl group or its salt (—COOM) or phosphonic acid or its salt (—$PO_3MM'$), wherein M and M' are the same as or different from each other and are selected from the group consisting of H, Na, K and ammonium ($NH_4$), and m and n are 0 or a round number of 1–5, respectively;

(2)

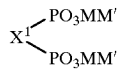

wherein $X^2$ is —$CH_2$—, —CH(OH)—, —$C(CH_3)$(OH)—, —CH(COOM)— or —$C(CH_3)$(COOM)— and M and M' are as defined above;

(3)

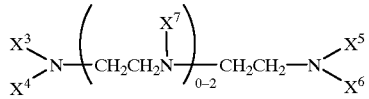

wherein $X^3$ and $X^7$ are same as $X^1$ above, provided that at least 2 among $X^3$–$X^7$ are substituted with a phosphonic acid or a phosphonic acid salt (—$PO_3MM'$); and M and M' are as defined above.

15. An non-electrolytic gold plating method comprising the steps of:

(1) providing the non-electrolytic gold plating liquid of claim 1; and (2) immersing an article having a surface of a metal selected from the group consisting of nickel, cobalt, palladium, or a metal alloy containing nickel, cobalt or palladium, in said non-electrolytic gold plating liquid.

* * * * *